US006216789B1

(12) United States Patent
Lorsignol et al.

(10) Patent No.: US 6,216,789 B1
(45) Date of Patent: Apr. 17, 2001

(54) HEAVE COMPENSATED WIRELINE LOGGING WINCH SYSTEM AND METHOD OF USE

(75) Inventors: Marc Lorsignol; Angus Armstrong; Marvin W. Rasmussen, all of Austin; Laurent Farnieras, Stafford, all of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/356,432

(22) Filed: Jul. 19, 1999

(51) Int. Cl.[7] ..... E21B 15/02
(52) U.S. Cl. ..... 166/355; 254/900; 254/266
(58) Field of Search ..... 166/355; 254/900, 254/275, 268, 266

(56) References Cited

U.S. PATENT DOCUMENTS 3,001,396 * 9/1961 Cleveland ..... 166/355
4,132,387 * 1/1979 Somerville et al. ..... 254/173
4,349,179 * 9/1982 Barber ..... 254/240
4,428,421 1/1984 Rankin .
4,547,857 * 10/1985 Alexander ..... 166/355
4,576,517 3/1986 McCann et al. .
4,730,677 3/1988 Pearce et al. .
4,932,261 6/1990 Henrion .
4,962,817 10/1990 Jones et al. .
5,209,302 5/1993 Robichaux et al. .

* cited by examiner

*Primary Examiner*—David Bagnell
*Assistant Examiner*—John Kreck
(74) *Attorney, Agent, or Firm*—John J. Ryberg; Brigitte L. Jeffery

(57) ABSTRACT

A computer controlled heave compensation wireline logging winch system and method of use that compensates for the effects of wave motion on floating installations performing wireline logging measurements. A wireline winch and wireline cable with a logging measurement tool attached is installed on a floating installation. Vessel vertical movement is measured and is physically compensated for by a change in speed of the wireline cable so that the logging data is obtained at a controlled speed. Any error in this physical compensation is detected by a depth measurement system and is used to adjust the true depth at which the logging tool measurements are being recorded.

42 Claims, 9 Drawing Sheets

ALARM GENERATION DEPTH MEASUREMENT SYSTEM
150
151
TOOL ABOVE TRANSITION REGION ?
YES
NO
152
HEAVE COMPENSATION ACTIVE ?
YES
A
153
TOOL BELOW TRANSITION REGION ?
YES
154
HEAVE COMPENSATION ACTIVE ?
NO
A
CLEAR ALARM
155
156
SET ALARM
END

HEAVE COMPENSATED WIRELINE LOGGING WINCH SYSTEM AND METHOD OF USE

BACKGROUND

This invention relates generally to computer-controlled winch systems for wireline logging. More particularly, the invention is a computer-controlled heave compensation wireline logging winch system that compensates for the effects of wave motion on floating installations performing wireline logging.

Wireline logging is the process by which oil or gas wells are surveyed to determine their geological, pertrophysical or geophysical properties using electronic measuring instruments conveyed into the wellbore by means of an armored steel cable, known as a wireline cable. The wireline cable is stored on a winch drum, which provides the mechanism by which it is lowered into the well via a series of sheave wheels to ensure proper alignment. The measurements made by downhole instruments secured to the wireline cable are transmitted back to a data acquisition computer located at the surface through electrical conductors in the wireline cable. Electrical, acoustical, nuclear and imaging tools are used to stimulate the formations and fluids within the wellbore and the electronic measuring instruments then measure the response of the formations and fluids. A device mounted close to the cable drum at the surface determines the depth at which these measurements are recorded. This device measures cable movement into and out of the well and is known as the depth system. The wireline well log contains the record of the series of measurements of the formations and fluids found in the wellbore with respect to the location within the borehole at which measurements are made. The raw measurements are often presented in the form of an x-y graph with the location where the measurement is made recorded on the y-axis and the measurement itself recorded on the x-axis. The location where the measurement is made is called the depth. It is a measure of the distance between a reference position, usually located somewhere on the surface above the well, and the location within the borehole following the path of the borehole.

The accuracy and quality of the wireline logging data obtained from such an arrangement is dependent on the smooth movement of the wireline cable and the downhole logging tools that extend from the wireline cable at a known and controlled speed, along with the precise determination of the depth at which the wireline logging measurements are made. Depth may be calculated by measuring the amount of cable spooled off or on the winch and may be adjusted for conditions in the borehole and characteristics of the cable. One cable characteristic that may be adjusted for is cable stretch, which is a function of temperature, pressure, tension and length of the cable.

For a fixed wireline setup, such as a land drilling rig or fixed offshore platform, the measurement of depth and cable speed is relatively straightforward. This is because the variables in the system can be measured and accounted for. On a land rig or fixed drilling rig, there is a fixed distance between a reference point at the surface of the well itself and the winch. Because the distance is fixed, it may be automatically adjusted out of the depth calculation. However, when the winch is installed on a floating vessel, which may typically be a semisubmersible rig, drill ship or barge, the movement of the rig itself due to tidal or wave motion effects is not taken into account by conventional wireline logging systems. In a floating vessel installation, the distance between the reference point at the surface of the well and the winch is not fixed and the distance changes with respect to the tide and waves. If ignored, the vertical component of this motion, relative to the wellbore, will have an adverse affect on the indexing and analysis of the log data. The movement of the wireline cable and the downhole logging tools induced by the movement of the rig, drillship or barge will not be measured. This same problem occurs if the rig is fixed, but the wireline winch is located on a floating tender.

Other systems have attempted to minimize the effects of wave motion on wireline logging data. The system is often compensated in such a way as to keep the wireline set-up fixed with respect to a known reference datum, usually the sea floor. This is normally achieved by interfacing with the drilling rig's compensation system, and using it to anchor the wireline rig to the fixed datum. A compensation device, usually in the crown of the rig, attempts to hold the cable distance constant using an electro-hydraulic device. This system is limited in its precision and the range of motion over which it can compensate since it relies on a passive compensation system designed for very heavy drill pipe strings and uses steel ropes to anchor the wireline upper sheave wheel to the seabed. The wireline acquisition system then assumes that the setup is not changing and is fixed. This type of system is high maintenance and expensive. Alternatively, an electromechanical compensation device can be inserted between the winch and the upper sheave wheel to be used for well logging only. Since well logging is done somewhat infrequently, this device is often idle. In both of these types of systems, no corrections are made for any errors induced by incomplete heave compensation.

SUMMARY

The present invention solves the problem of wave motion on wireline logging data firstly by physically compensating for vertical motion (heave) at the wireline winch and secondly, by calculating and recording any errors in that physical compensation so that the true depth at which a wireline log data measurement is made is recorded, along with the wireline well log measurement. Both the physical compensation system and the recording of errors in that physical compensation system utilize information on the physical movement of the rig itself, obtained from a motion reference unit (MRU). An electrically controlled wireline winch provides for the physical heave compensation. The wireline winch is fixed to the rig structure itself with no external compensation system connected. The movement of the wireline cable due to heave is measured by the MRU and is compensated for by the winch with a corresponding change in motion and/or direction of the wireline cable. This ensures that the wireline logging data is acquired at a constant, known speed. Any error in this compensation is detected by the depth system within a data acquisition computer located at the surface, recorded and may be used to adjust the true depth at which the wireline log measurements are being recorded.

The present invention comprises a system and method for compensating for the vertical motion of a floating vessel having a winch control means for receiving vessel vertical motion data and logging tool speed set points and a wireline winch means for raising and lowering a wireline cable within a wellbore, connected to the winch control means and comprising a winch motor for attaching to and rotatably moving a cable drum, the wireline cable having at least one logging measurement tool attached to an end of the wireline cable extending from the cable drum. The winch control means combines the vertical motion data and logging tool speed set points to produce a winch motor control signal for controlling the rotatable movement of the cable drum so as to cause the wireline cable to achieve movement within the wellbore at a controlled speed, which may be substantially constant, independent of vessel vertical motion. The system can also compensate for the vertical motion of a floating vessel using a winch control means for receiving vessel vertical motion data and logging tool tension set points and a wireline winch means for raising and lowering a wireline cable within a wellbore, connected to the winch control means and comprising a winch motor for attaching to and rotatably moving a cable drum, the wireline cable having at least one logging measurement tool attached to an end of the wireline cable extending from the cable drum. The winch control means combines the vertical motion data and logging tool tension set points to produce a winch motor control signal for controlling the rotatable movement of the cable drum so as to cause the wireline cable to achieve movement within the wellbore at a controlled speed, which may be substantially constant, independent of vessel vertical motion. Alternatively, logging tool speed and tension set points can be simultaneously used together with the vessel vertical motion to produce a winch motor control signal. The winch motor control signal comprises a RPM value and a torque value. Producing a winch motor control signal by the winch control means may occur in real time.

The system further comprises a depth computing means for receiving the vessel vertical motion data and measured wireline cable motion data and for calculating a heave compensation depth error by combining the measured wireline cable motion data and the vessel vertical motion data. The vertical motion data comprises vessel vertical position, speed and acceleration. The heave compensation depth error is saved together with logging measurement tool data from the logging measurement tools. The depth error may be used to compensate a depth measurement of the logging measurement tool data.

The system further comprises an alarm generation means for producing an alarm signal when the logging tool is about to enter a position above the wellbore and a heave compensation mode is activated or when a heave compensation mode of operation should be activated. The alarm signals are displayed on an operator display console connected to the depth computing means. At least operator control and display means for entering operator commands, displaying winch system status and providing feedback to an operator of heave compensation status is provided.

The present invention comprises a computer program for calculating a heave compensation depth error value comprising receiving measured speed from a first cable movement measuring device and converting the measured speed into a physical distance. A wheel wear correction, a heave compensation amount and a crank compensation amount pending are applied to produce a first net motion increment. A slip detection correction is applied to the first net motion increment and the net motion increment is converted into a first depth value. The process is repeated for receiving measured speed from a second cable movement measuring device and a second depth value is determined. The first depth value or the second depth value that is most advanced in cable motion direction is then selected. The selected depth value is saved together with logging measurement tool data. It may be used to compensate a depth measurement of the logging measurement

BRIEF DESCRIPTION OF THE DRAWINGS

These and other features, aspects and advantages of the present invention will become better understood with regard to the following description, appended claims and accompanying drawings where:

DETAILED DESCRIPTION OF THE DRAWINGS

Figure 1:
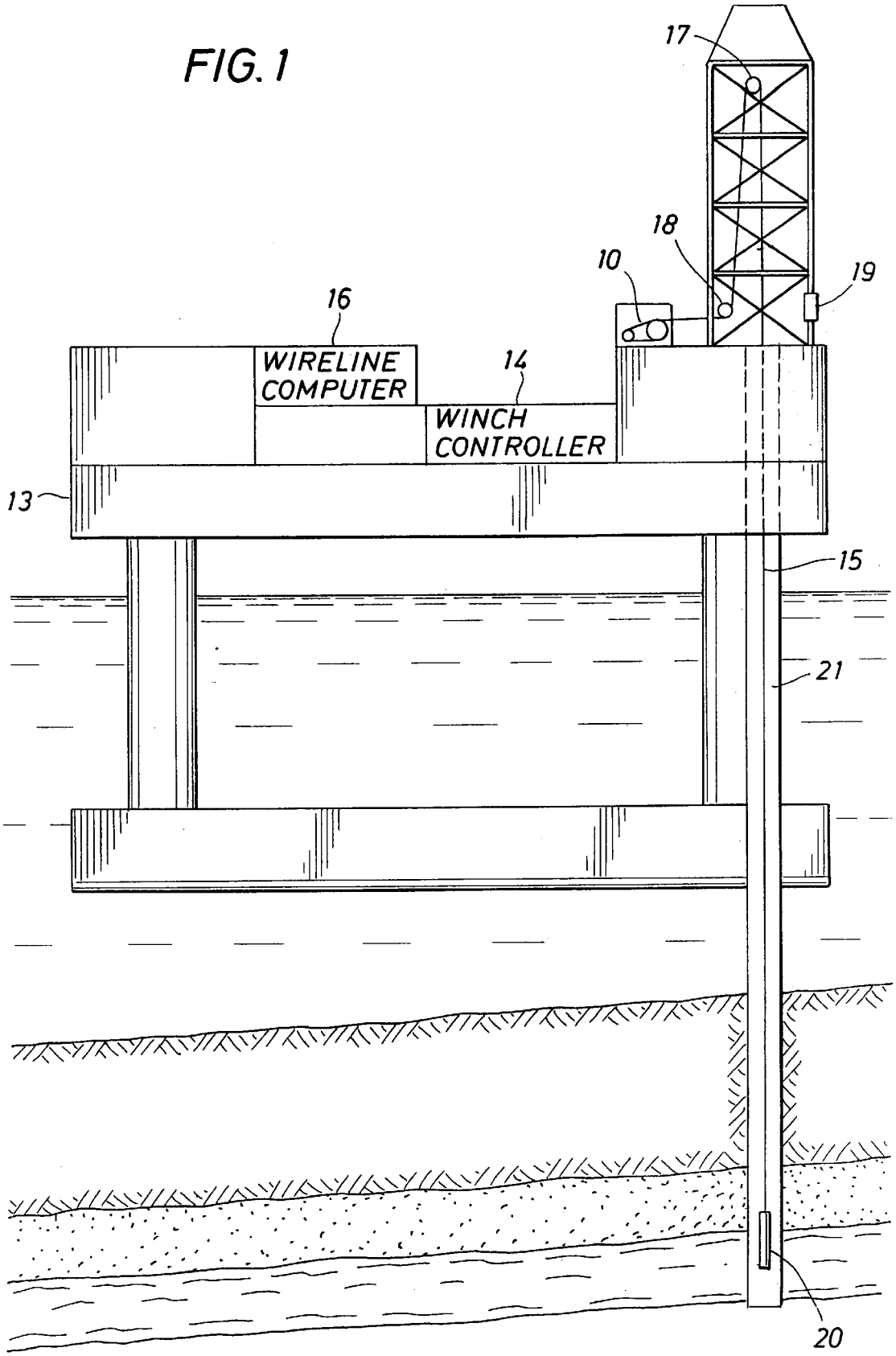
FIG. 1 is a diagram showing the heave compensated wireline logging winch system mounted on a floating vessel.
Figure 2:
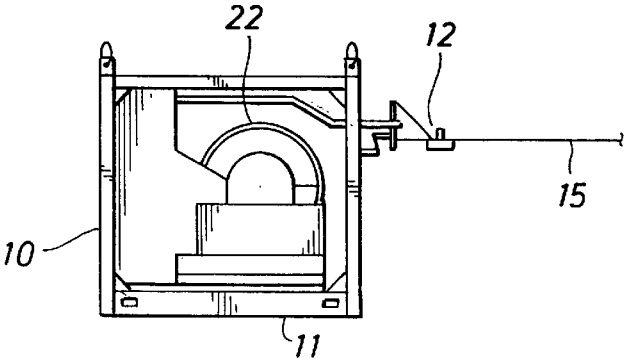
FIG. 2 is a diagram of the winch of FIG. 1.

FIG. 1 is a diagram showing the heave compensated wireline logging winch system mounted on a floating rig. The system may also be mounted on various types of floating vessels or submersible vessels that may be used to perform wireline logging. FIG. 2 is a diagram of the winch 10 of FIG. 1. Referring now to FIGS. 1 and 2, the winch 10 is mounted on a winch skid 11 located on the floating rig 13. A winch controller 14, adjacent or remotely connected to the winch 10 provides the commands to control the action of the winch 10 and thereby control the vertical movement of the wireline cable 15 within the well 21. The winch skid 11 is able to receive a cable drum 22, which can be a large or small drum using either a heptacable or monocable setup. Logging tools 20 are attached to one end of the wireline cable 15. A wireline computer 16 interfaces with the winch controller 14. A cable movement measuring device 12, which measures cable speed and tension as the cable exits the cable drum 22, is gimbal mounted and located just outside the winch 10 and comprises two wheels located side by side with the wireline cable 15 running between the wheels. The cable movement measuring device may comprise one device or two devices. If there are two devices, one usually measures cable speed and another cable tension. As the wireline cable 15 moves, the cable movement measuring device measures the amount and direction of wheel rotation electronically. An upper sheave wheel 17 and lower sheave wheel 18 are used to align the wireline cable 15 with the well and the winch. A motion reference unit (MRU) 19 located near the wireline cable 15 provides measured vertical position, speed and acceleration of the floating rig 13 at the derrick floor and provides that information to the winch controller 14, which uses the information along with measurement data from the cable movement measuring device 12 to control the winch 10 and physically compensate for vertical motion on the wireline cable 15 by changing the speed and/or direction of the wireline cable 15 motion. The winch controller 14 also provides the vertical motion information to the wireline computer 16. The wireline computer 16 uses the vertical motion information and the measurement data from the cable movement measuring device 12 to detect any errors in the physical compensation and to record the true depth at which the wireline log measurements are taken.

Figure 3:
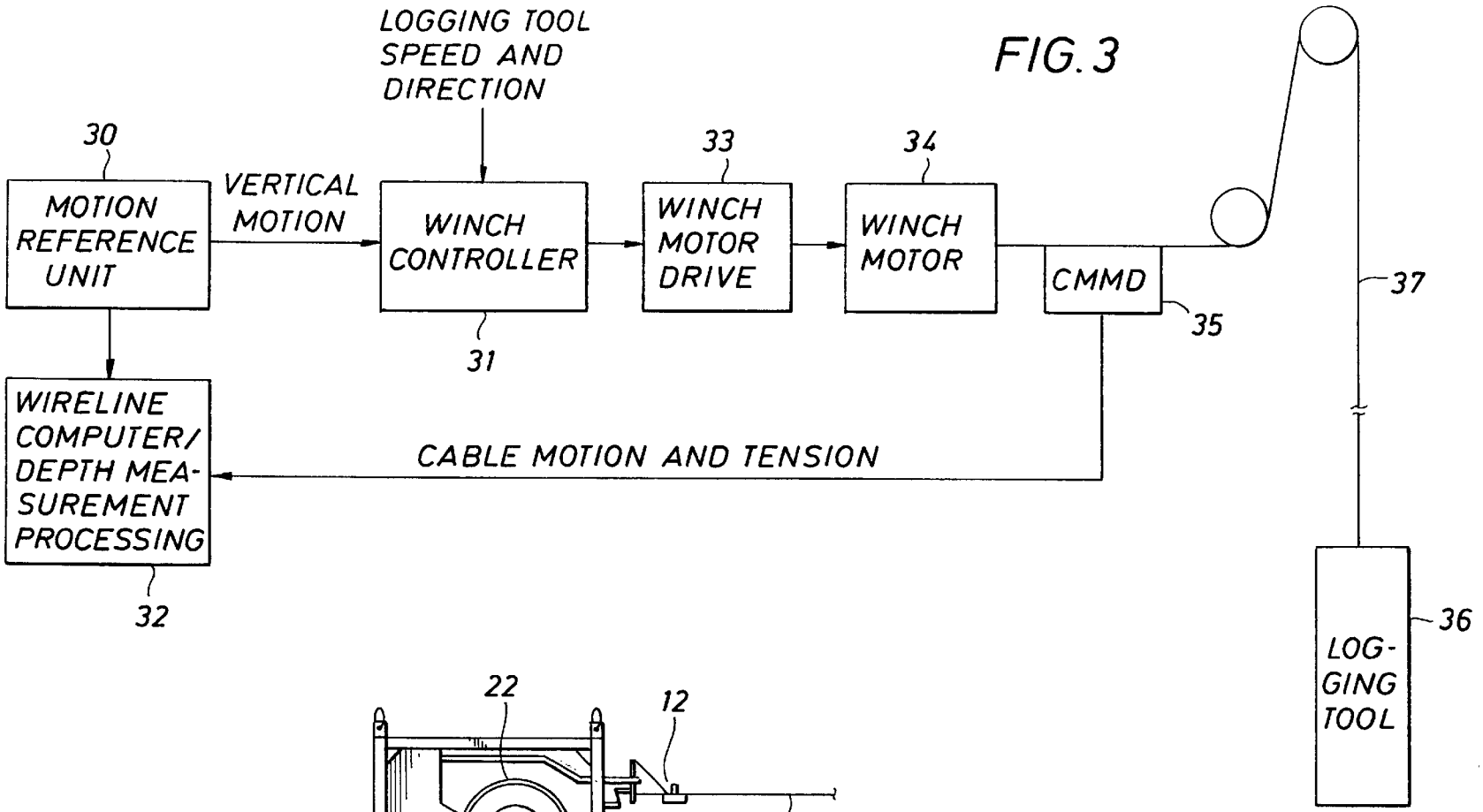
FIG. 3 is a block diagram of the physical heave compensation system and the physical correction made by the winch.

FIG. 3 is a block diagram of the physical heave compensation system and the physical correction made by the winch. The motion reference unit (MRU) 30 detects vertical motion of the drilling platform, which is used by the winch controller 31 and the wireline computer depth measurement processing 32. Based on the vertical motion, the winch controller 31 calculates the necessary changes in the winch motor 34 speed and direction to keep the wireline cable 37 and the wireline logging tool 36 at a constant or controlled speed while being lowered or raised in the wellbore. The winch controller 31 sends a command to change speed and direction to the winch motor drive 33, which in turn controls the winch motor 34. The cable movement measuring device (CMMD) 35 measures cable motion and tension of the wireline cable 37 as it exits the winch drum. This measurement takes into account the amount of correction physically applied to the wireline cable 37 and the measurement is sent to the wireline computer 32. The depth measurement system within the wireline computer detects any error in this compensation by comparing the actual vertical motion as measured by the MRU 30 with the physical correction made by the winch. Any error in the physical compensation may be used to adjust the true depth at which the measurements are being recorded.

Figure 4:
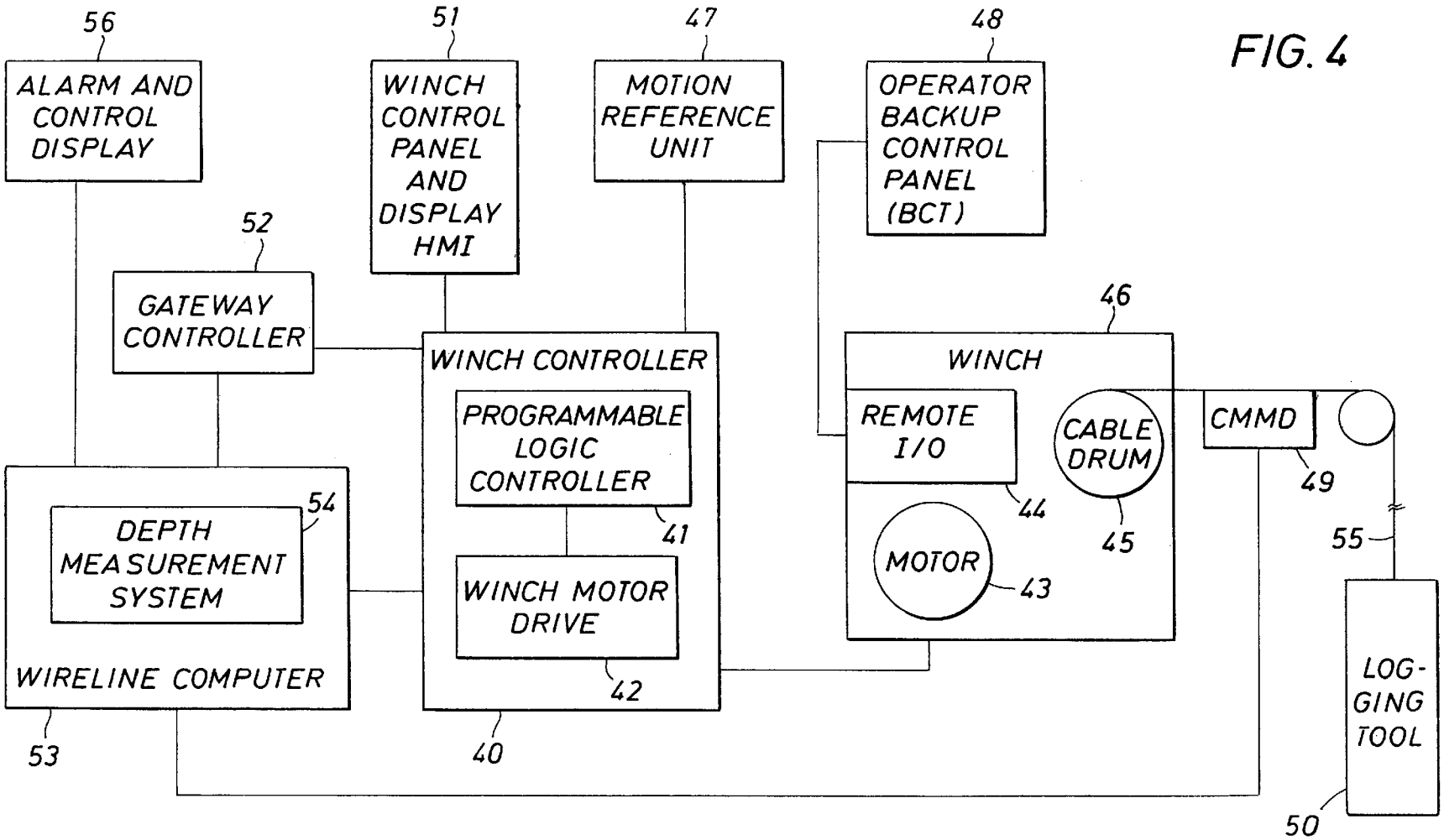
FIG. 4 is a system block diagram of the heave compensation wireline logging winch system.

Turning now to FIG. 4, a system block diagram of the heave compensation wireline logging winch system is shown. The winch controller 40 comprises a programmable logic controller (PLC) 41 and a winch motor drive 42, which may be a variable speed drive. The winch controller 40 computes the parameters for accurately controlling the motion of the wireline winch 46. The motion of the winch is achieved through the winch motor drive 42 and motor 43, which are connected using an electrical cable. Using the winch motor characteristics and a winch motor model, the winch motor drive 42 can accurately control the winch motor 43 using the motor frequency and voltage. An encoder mounted on the motor shaft is connected to the winch motor drive so that increased precision may be achieved. The winch remote I/O 44 communicates with the PLC 41. The winch remote I/O 44 collects information and sends commands to ancillary systems on the winch such as the brakes, steering, oscillating, light, operator backup control panel (BCT) 48 and general alarms. The motion reference unit 47 provides the vertical information about the floating rig or vessel to the winch controller 40 which is forwarded to the depth measurement system 54 processing in the wireline computer 53. The winch controller 40 uses the vertical information (which comprises position, speed and acceleration) to calculate the necessary physical compensation in motor 43 speed and direction to keep the wireline cable 55 and the wireline logging tool 50 at a constant speed. The depth measuring system 54 within the wireline computer 53 accepts the measured cable speed and tension from the cable movement measuring device 49. Using the vertical position from the MRU 47, through the gateway controller computer 52, and the measured cable speed and tension, the depth measuring system 54 computes any error in the physical compensation to calculate the logging depth at which the wireline logging measurements are made, which is then recorded by the wireline logging software. This information is sent back to the winch controller 40 through the gateway controller 52 which provides the interface between the depth measurement system 54 and the PLC 41. Commands from the operator are input from a winch control panel and display human machine interface (HMI) 51, which contains operator controls and displays. The HMI 51 may also be used to control other functions for different rig processes such as drilling or pumping. Depending on the various modes of operations, the winch controller 40 with its PLC 41 processes wireline computer 53 and motion reference unit 47 information and operator commands from the HMI 51 to determine the required motor 43 speed and torque and sends this information to the winch motor drive 42 for execution. The winch motor drive 42, which may be a variable speed, alternating current motor drive, receives RPM/torque commands and generates the required electrical signals for controlling the winch motor 43. The winch motor drive 42 has its own built-in sensors for RPM (with a tachometer mounted on the motor) and torque. It exchanges the start/stop and brake on/off status with the PLC 41. The winch controller 40 then energizes the brake accordingly through the winch remote I/O 44. The winch devices 46 are electric and electro-pneumatic components that control braking, oscillating, spooling and other winch functions. These components are activated through the winch remote I/Os 44. An operator backup panel human machine interface (HMI) 48 is used for backup control and allows the operator to perform a reduced set of operator commands. The operator backup panel HMI 48 can be used in place of the winch control panel, when for example, the operator interface HMI 51 is being used to control other functions for different rig processes. The operator panel HMI 48 is linked to the winch controller via the winch remote I/Os 44. The depth measuring system 54 interfaces with an alarm and control display 56 for displaying alarm and control status information to an operator.

The cable drum 45 can be a large or small drum with either heptacable or monocable. The cable drum 45 can have a flange diameter between about thirty inches and sixty inches and a cable length maximum capacity of about 40,000 ft. depending on the cable flange diameter and cable diameter. The cable drum 45 may be equipped with a one and one half inch pitch sprocket (between about 72 and 80 teeth), pillow blocks and a brake band surface on both sides of the cable drum 45. In normal mode (not wave compensated), with a 140 kVA (110 kW) variable speed drive and depending upon the type and size of the cable drum, the winch allows for the delivery of a maximum cable speed of about 54,000 ft/hr and a minimum cable speed of about 42 ft/hr and a maximum pull on line of 26,100 lbs.

Figure 5:
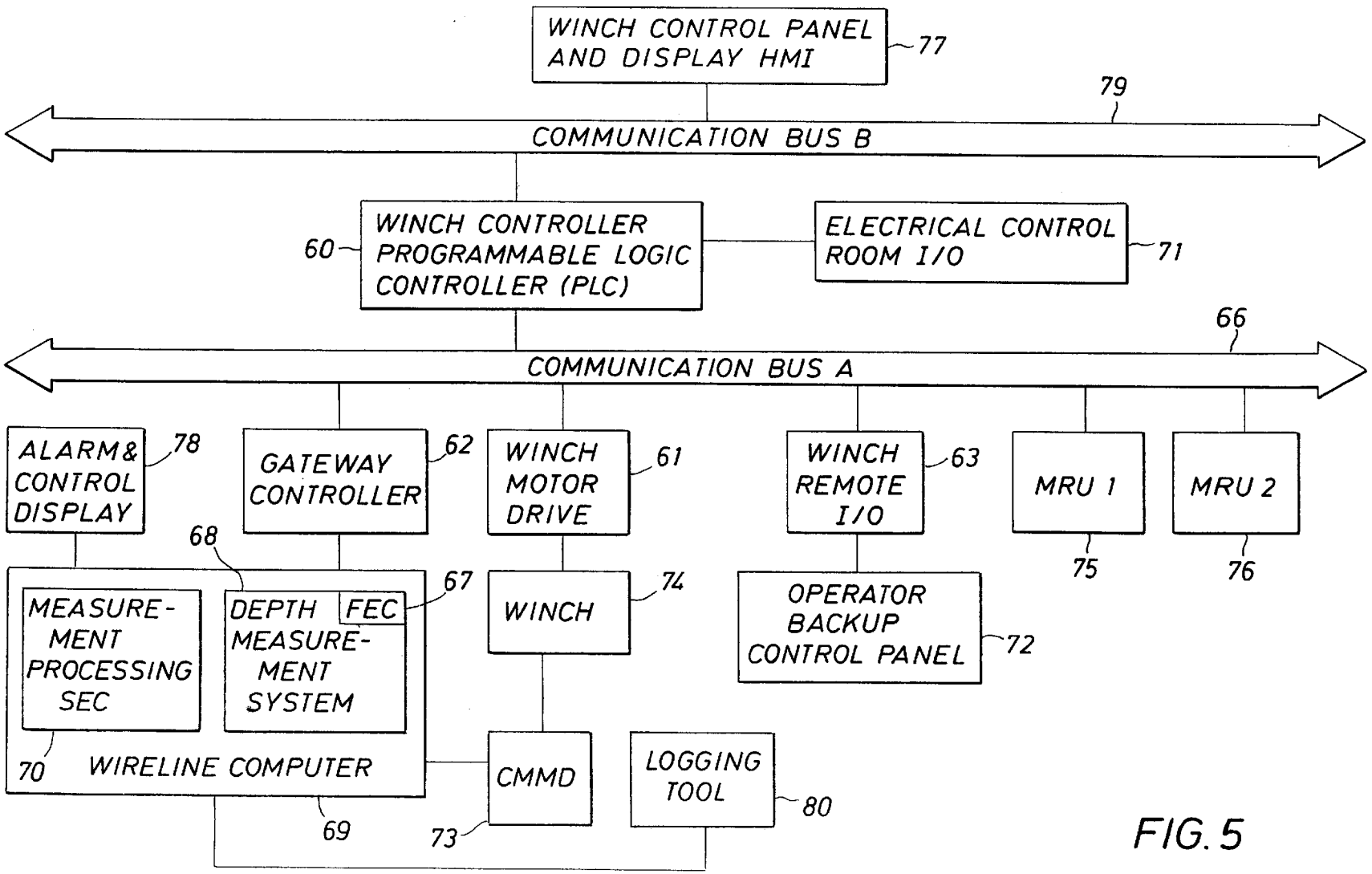
FIG. 5 is a network architecture diagram of the wireline winch controller with system and operator interfaces.

Turning now to FIG. 5, a network architecture diagram of the wireline winch controller with system and operator interfaces is shown. The winch controller programmable logic controller (PLC) 60 communicates with the winch controller/winch motor drive 61, the gateway controller computer 62, winch remote I/O (WRIO) 63 and motion reference unit one (MRU 1) 75 and motion reference unit two (MRU 2) 76 via a communication bus 66. There may be one or more motion reference unit devices to provide estimated linear acceleration, estimated relative position and estimated linear velocity in the vertical axis. The winch motor drive 61 is connected to the winch motor located in the winch 74. The winch remote I/O 63 interfaces with the operator backup control panel (BCT) 72 and sends operator commands from the operator backup control panel (BCT) 72 to the winch controller PLC 60. The gateway computer 62 interfaces with the wireline computer 69 which contains a front end controller (FEC) 67, depth measurement system 68 and measurement processing (SEC) 70. The cable movement measuring device 73 sends cable speed and tension to the depth measurement system 68. The depth measurement system sends alarm and winch control data directly to the alarm and control display 78. The same information sent to the alarm and control display 78 is also sent to the gateway controller 62. The gateway controller 62 reformats this data as necessary and sends it to be displayed on the winch control panel and display HMI 77 via the winch controller programmable logic controller (PLC) 60. Logging tool 80 measurements are sent to the SEC 70 within the wireline computer 69. The SEC 70 combines the output of the depth measurement system and the wireline logging measurements and sends that information to be recorded. The winch controller PLC 60 is electrically connected to the electrical control room input/output 71. The winch controller PLC 60 communicates with the winch control panel and display HMI 77 via a communication bus 79. The winch 74 can be controlled from several locations including the winch control panel and display HMI 77 and the operator backup control panel (BCT) 72. The PLC 60 communicates with the winch control panel and display HMI 77 and sends winch control status and parameters along with error messages.

Figure 6:
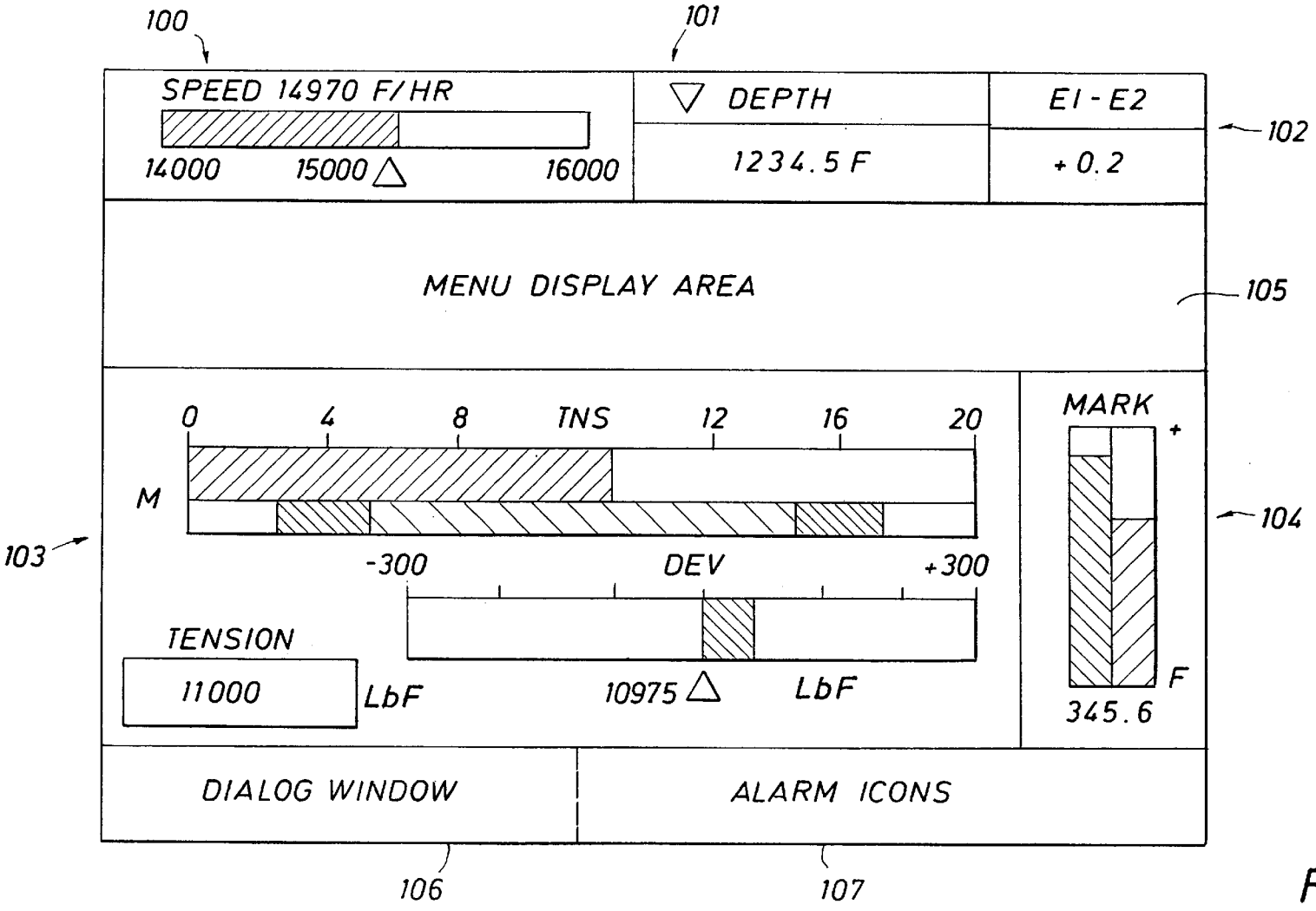
FIG. 6 shows the layout of a typical wireline winch logging status display.

FIG. 6 shows the layout of a typical wireline winch logging status display. There is a winch wireline cable speed display area 100, a logging tool depth area 101, an auxiliary display area 102, a cable tension display area 103, a magnetic mark display area 104 and a menu display area 105. The display also contains a dialog window 106 and alarm icons 107.

Figure 7:
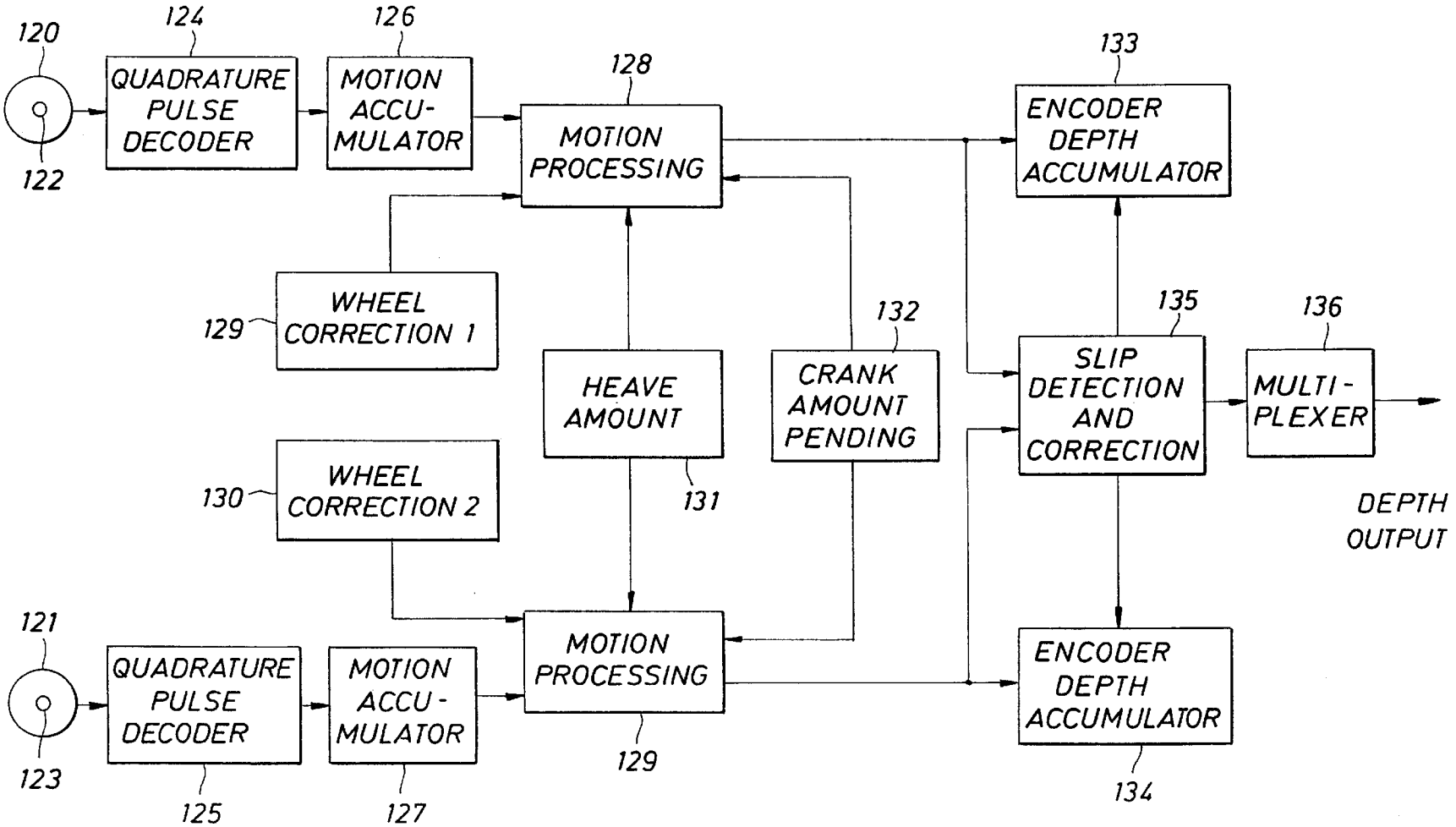
FIG. 7 shows a hardware/software block diagram of the depth measurement processing.

FIG. 7 shows a hardware/software block diagram of the depth measurement processing. The cable movement measuring device (CMMD) 12 of FIG. 2 is gimbal mounted just outside the winch and is fixed in the roll axis. A wireline cable 15 is secured between two integrated depth measuring wheels 120 and 121 by means of cable guides and spring loaded rollers. On each wheel is a rotary encoder 122,123 that measure the amount and direction of rotation, where two times IT times the radius of each of the measuring wheels 120, 121 equals the amount of cable motion. Redundancy of measurement is provided because each of the encoders 120, 121 separately measures the amount and direction of rotation and the measurements from each CMMD measuring wheel 120, 121 are processed in parallel. First, the measurements from the measuring wheels 120, 121 comprising raw quadrature data are received by the quadrature pulse decoders 124,125 and are converted into incremental or decremental counts which are fed into motion accumulators 126,127, where one detectable motion of the measuring wheels 120, 121 corresponds to one accumulator count. Next, the software begins motion processing 128, 129. The accumulator counts, which correspond to motion increments or decrements over a sample period of time, are converted to a physical distance. Wheel correction for each wheel 128, 129, heave amount 131 (as measured by the MRU) and crank compensation 132 are applied, as necessary. Wheel correction 129, 130 compensates for changes in measuring wheel wear since as the measuring wheels are used the wheels wear so the radius of the wheel changes and a corresponding wheel correction must be applied. If a crank amount is pending 132, it is applied during the motion processing. Crank is a manual adjustment to the wireline cable that the winch engineer can enter to mechanically emulate a clutch assembly that was present in early winch systems. The engineer sets the amount of crank (change in the amount of wireline cable) and the electronics feed in the change to the winch uniformly and slowly over some period of cable motion. If heave compensation mode is selected, a heave measurement 131 that has been obtained from a motion reference unit is also applied. The output of the motion processing function 128, 129 is the net motion increment and cable speed. The net motion increment is calculated by subtracting the heave amount from the measured cable motion, where the measured cable motion is the logging tool motion plus the actual heave compensation applied by the winch control. Any cable slip detection and correction 135 is added to the net motion increment and the result is converted to depth in the encoder depth accumulators 133, 134. In the multiplexor 136, an algorithm is used to choose the best of the two estimates from both measuring wheels 120, 121 based on the measurement most advanced in direction of the wireline motion. The measured depth is then output to the logging system for recording, to the operator displays and to an alarm generation function.

Figure 8:
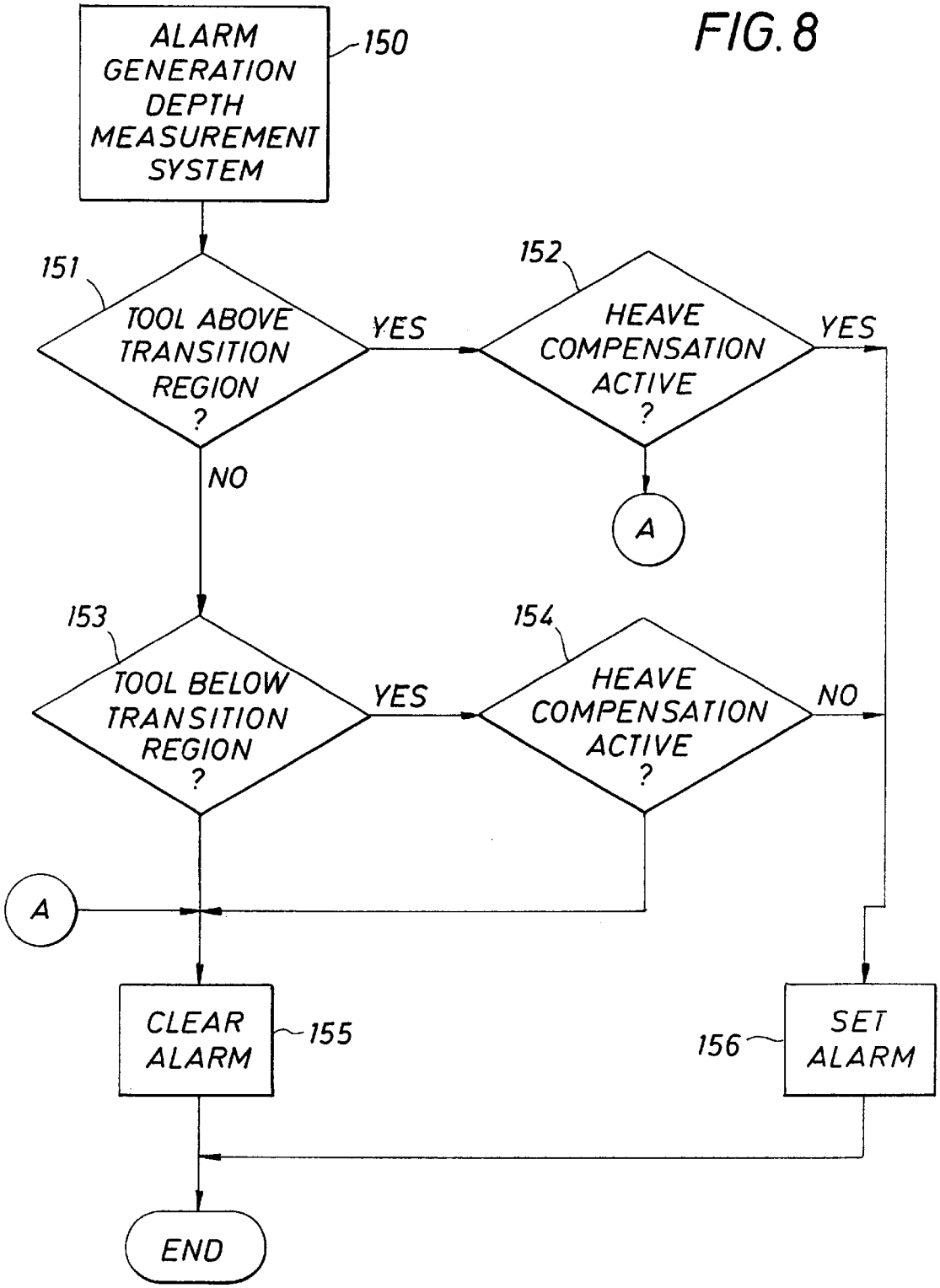
FIG. 8 is a flowchart of the alarm generation function of the depth measurement system.

FIG. 8 is a flowchart of the alarm generation function of the depth measurement system 150. An alarm is set 156 when the well logging tool is outside the transition region and the winch is not in the appropriate mode. A transition region is a designated length of the well in which it is safe for the heave motion compensation to be either on or off. When heave motion compensation is off and the tool is stopped the tool does not move with respect to the rig, but does move with respect to the well and the sea bed. With heave motion compensation on, the tool moves with respect to the rig, but is stationary with respect to the formations in the well. Outsider of the transition region towards the surface, heave motion compensation should be turned off so that the tool may be safely handled on the rig floor. Outside the transition region, towards the bottom of the well, heave motion compensation should be turned on so that the tool motion, with respect to the formations in the well, is not affected by the rig motion. If the tool is above the transition region 151 and heave compensation is on 152, an alarm is set 156. If the tool is above the transition regions 151 and heave compensations 152 is off, the alarm is cleared 155. If the tool is below the transition region 153 and heave compensation is off 154, an alarm is set 156. If the tool is below the transition region 153 and heave compensation is active 154, the alarm is cleared 155. The alarm may then be displayed on the alarm and control display and may also be available for display on the winch control panel and display HMI.

Figure 10:
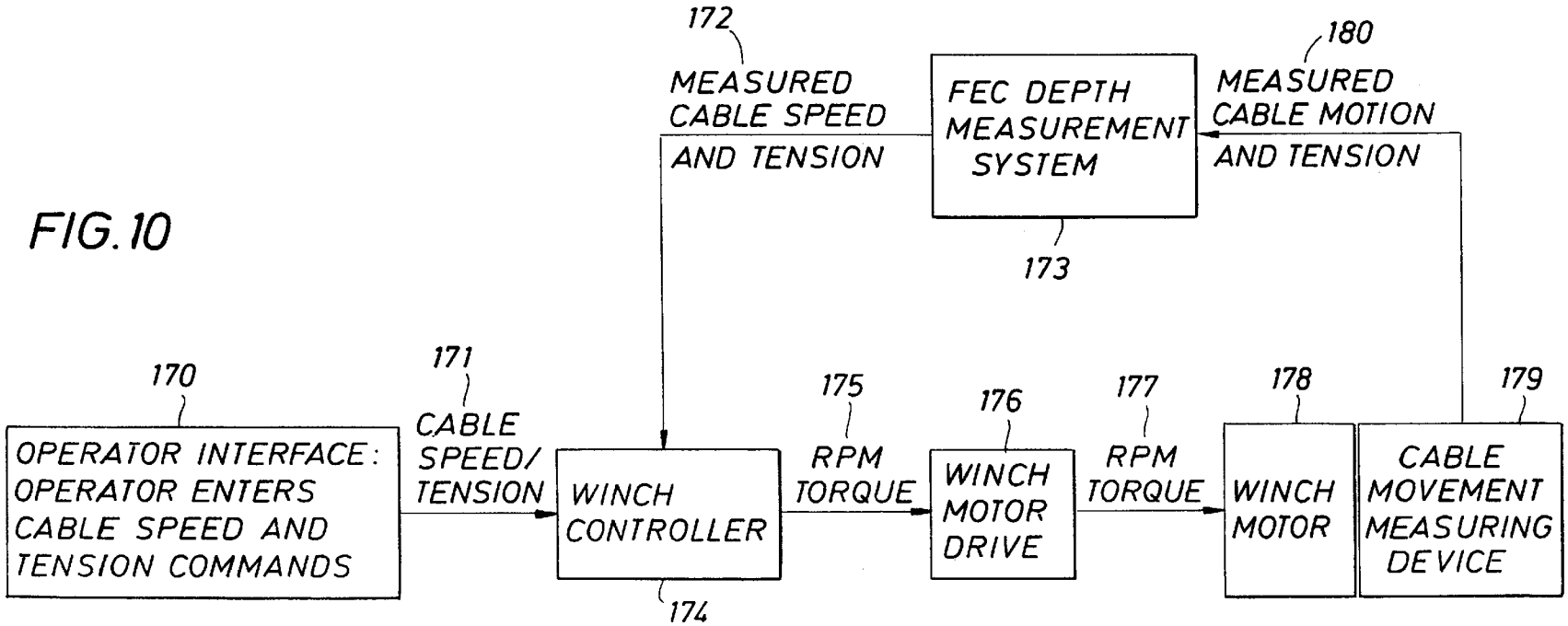
FIG. 10 shows a control flow diagram of the winch operation in cruise mode.
Figure 11:
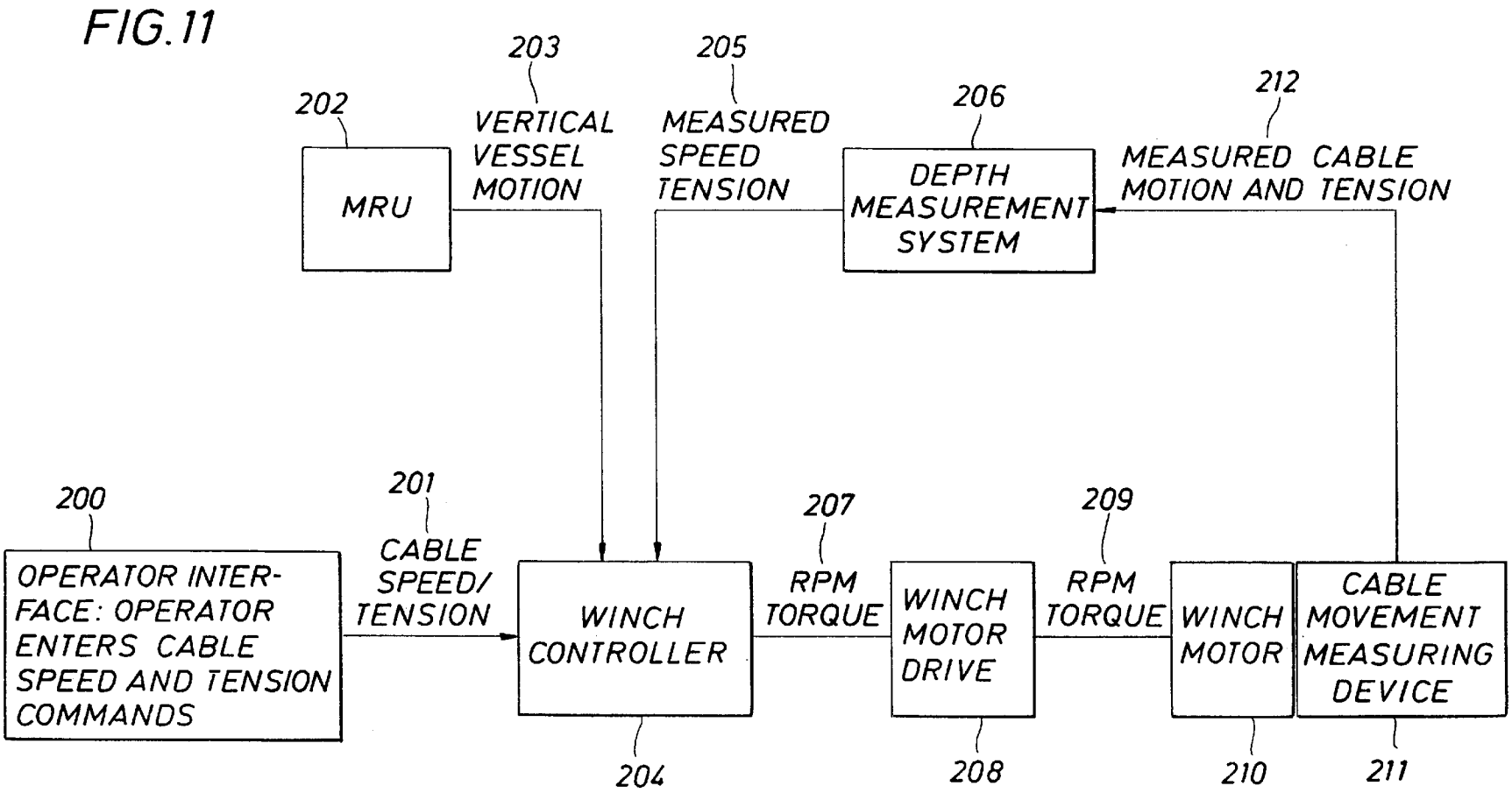
FIG. 11 shows a flow control diagram of the winch operation in heave compensated mode.

The winch may be operated in three modes of operation: manual mode (FIG. 9), cruise mode (FIG. 10) and heave compensated mode (FIG. 11).

Figure 9:
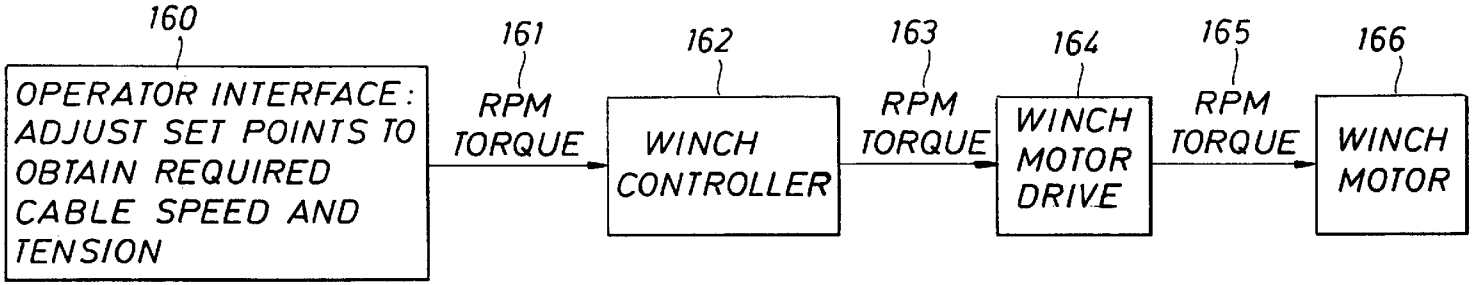
FIG. 9 shows a control flow diagram of the winch operation in manual mode.

FIG. 9 shows a control flow diagram of the winch operation in manual mode. In this mode, the operator manually adjusts the RPM and torque set points at the operator interface to obtain the required cable speed and tension 160. The RPM/torque 161 is sent to the winch controller 162, which scales the RPM/torque commands 163 and sends them to the winch motor drive 164 which in turn sends the RPM/torque commands 165 to the winch motor 166. The winch controller 162 contains a drum revolution counter that gives the number of motor revolutions and therefore the number of drum revolutions. When cable speed and depth are received from the FEC, a comparison is made for each drum revolution to compute the relationship between depth and drum revolutions and between cable speed and motor RPM. When cable speed and depth are no longer received, the relationship is used to calculate an estimated cable speed and tool depth. When cable tension is received from the FEC, a comparison is made for each drum revolution to compute the relationship between the cable tension and the winch motor torque. When cable tension is no longer received, the relationship is used to calculate an estimated cable tension.

FIG. 10 shows a control flow diagram of the winch operation in cruise mode. In cruise mode, the operator at the operator interface 170 inputs cable speed and cable tension commands 171. The measured cable speed and cable tension 172 is computed by the front end controller (FEC) within depth measurement system 173 using cable movement measuring device 179 measured cable motion and tension 180 and is transmitted to the winch controller. Using the cable speed and tension 171 input by the operator and the measured cable speed and tension 172, the winch controller 174 calculates and scales RPM/torque commands 175 and sends them to the winch motor drive 176, which in turn sends the RPM/torque commands to the winch motor 178.

FIG. 11 shows a flow control diagram of the winch operation in heave compensated mode. In heave compensated mode, the operator at the operator interface 200 inputs cable speed and cable tension commands 201, which are transmitted to the winch controller 204. The motion reference unit (MRU) 202 provides vertical vessel motion 203, which is also used by the winch controller 204. The measured cable speed and cable tension 205 is calculated by the front end controller within depth measurement system 206 using cable movement measuring device 211 measured cable motion and tension 212 and is transmitted to the winch controller. Using the cable speed and tension 201 input by the operator, the vertical vessel motion 203 from the MRU 202 and the measured cable speed and tension 205, the winch controller 204 calculates and scales RPM/torque commands 207 and sends them to the winch motor drive 208, which in turn sends the RPM/torque commands 209 to the winch motor 210. The winch controller 204 contains a drum revolution counter that gives the number of motor revolutions and therefore the number of drum revolutions. When cable speed and depth are received from the FEC 206, a comparison is made for each drum revolution to compute the relationship between depth and drum revolutions and between cable speed and motor RPM. When cable speed and depth are no longer received, the relationship is used to calculate an estimated cable speed and tool depth. When cable tension is received from the FEC 206, a comparison is made for each drum revolution to compute the relationship between the cable tension and the winch motor torque. When cable tension is no longer received, the relationship is used to calculate an estimated cable tension.

Although the present invention has been described in detail with reference to certain preferred embodiments, other embodiments are possible. Therefore, the spirit and scope of the appended claims should not be limited to the description of the preferred embodiments herein.

What is claimed is:

1. A system for compensating for vertical motion of a floating vessel comprising:

a. a wireline winch for raising and lowering a wireline cable within a wellbore, further comprising a winch motor for attaching to and rotatably moving a cable drum, the wireline cable having at least one logging measurement tool attached to an end of the wireline cable extending from the cable drum;

b. a winch control means connected to the wireline winch wherein the winch control means receives vessel vertical motion data and logging tool speed set points and combines the vertical motion data and logging tool speed set points to produce a winch motor control signal for controlling the rotatable movement of the cable drum so as to cause the wireline cable to achieve movement within the wellbore at a controlled speed independent of vessel vertical motion; and c. depth computing means for receiving the vessel vertical motion data and measured wireline cable motion data and calculating a heave compensation depth error by combining the measured wireline cable motion data and the vessel vertical motion data.

2. The system according to claim 1 wherein the winch control means further receives logging tool tension set points and combines the logging tool tension set points with the vertical motion data and logging tool speed set points to produce the winch motor control signal.

3. The system according to claim 2 wherein the vertical motion data comprises vessel vertical position, speed and acceleration.

4. The system according to claim 2 wherein the receiving vertical motion data and combining the vertical motion data and logging tool speed and tension set points to produce a winch motor control signal by the winch control means occurs in real time.

5. The system according to claim 2 further comprising a first operator control and display means for entering operator commands, displaying winch system status and providing feedback to an operator of heave compensation status.

6. The system according to claim 5 further comprising a second operator control and display means.

7. The system according to claim 1 wherein the controlled speed is substantially constant.

8. The system according to claim 1 wherein the winch motor is a variable speed drive alternating current motor.

9. A system for compensating for vertical motion of a floating vessel comprising:

a. a wireline winch for raising and lowering a wireline cable within a wellbore, further comprising a winch motor for attaching to and rotatably moving a cable drum, the wireline cable having at least one logging measurement tool attached to an end of the wireline cable extending from the cable drum;

b. winch control means connected to the wireline winch wherein the winch control means receives vessel vertical motion data and logging tool tension set points and combines the vertical motion data and logging tool tension set points to produce a winch motor control signal for controlling the rotatable movement of the cable drum so as to cause the wireline cable to achieve movement within the wellbore at a controlled speed independent of vessel vertical motion; and c. depth computing means for receiving the vessel vertical motion data and measured wireline cable motion data, and calculating a heave compensation depth error by combining the measured wireline cable motion, the tension set points, and the vessel vertical motion data.

10. The system according to claim 9 wherein the controlled speed is substantially constant.

11. The system according to claim 9, wherein the heave compensation depth error is saved together with logging measurement tool data from the logging measurement tools.

12. The system according to claim 11 wherein the heave compensation depth error is used to compensate a depth measurement of the logging measurement tool data.

13. The system according to claim 9 further comprising an alarm generation means for producing an alarm signal when the logging tool is about to enter a position above the wellbore and a heave compensation mode is active.

14. The system according to claim 13 wherein the alarm signal is displayed on an operator display console connected to the depth computing means.

15. The system according to claim 9 further comprising an alarm generation means for producing an alarm signal to indicate a heave compensation mode of operation should be activated.

16. The system according to claim 15 wherein the alarm signal is displayed on an operator display console connected to the depth computing means.

17. The system according to claim 9 wherein the operator enters the speed set point and the tension set point at an operator interface connected to the winch control means.

18. The system according to claim 9 wherein the operator enters the speed set point and the tension set point at an operator backup control panel connected to the winch control means through the wireline winch.

19. The system according to claim 9 wherein the winch motor control signal comprises a RPM value and a torque value.

20. A method of compensating for vertical motion of a floating vessel comprising:

a. receiving vessel vertical motion data and logging tool speed set points by a winch control means;

b. raising and lowering a wireline cable within a wellbore by a wireline winch connected to the winch control means further comprising a winch motor for attaching to and rotatably moving a cable drum, the wireline cable having at least one logging measurement tool attached to an end of the cable extending from the cable drum;

c. combining the vertical motion data and logging tool speed set points by the winch control means to produce a winch motor control signal for controlling the rotatable movement of the cable drum so as to cause the wireline cable to achieve movement within the wellbore at a controlled speed independent of vessel vertical motion and d. calculating a heave compensation depth error by combining the measured wireline cable motion data and the vessel vertical motion data.

21. The method according to claim 20 further comprising receiving logging tool tension set points and producing a winch motor control signal by combining the logging tool tension set points with the vertical motion data and logging tool speed set points.

22. The method according to claim 21 wherein the step of calculating the heave compensation depth error comprises combining the measured wireline cable motion and tension data and the vessel vertical motion data.

23. The method according to claim 22 further comprising saving the heave compensation depth error value together with logging measurement tool data.

24. The method according to claim 23 further comprising compensating a depth measurement of the logging measurement tool data using the heave compensation depth error value.

25. The method according to claim 22 further comprising saving the heave compensation depth error value together with logging measurement tool data.

26. The method according to claim 25 further comprising compensating a depth measurement of the logging measurement tool data using the heave compensation depth error value.

27. The method according to claim 22 wherein the vertical motion data comprises vessel vertical position, speed and acceleration.

28. The method according to claim 22 further comprising producing an alarm signal by an alarm generation means when the logging tool is about to enter a position above the wellbore.

29. The method according to claim 28 further comprising producing an alarm signal by an alarm generation means when the logging tool is about to contact a bottom of a well.

30. The method according to claim 29 further comprising displaying the alarm signal on an operator display console connected to the depth computing means.

31. The method according to claim 30 further comprising displaying the alarm signal on an operator display console connected to the depth computing means.

32. The method according to claim 21 wherein the vertical motion data comprises vessel vertical position, speed and acceleration.

33. The method according to claim 21 wherein the receiving vertical motion data and combining the vertical motion data and logging tool speed and tension set points to produce a winch motor control signal by the winch control means occurs in real time.

34. The method according to claim 21 further comprising entering the speed and tension set points by an operator at an operator interface connected to the winch control means.

35. The method according to claim 21 further comprising entering the speed and tension set points by an operator at an operator backup control panel connected to the winch control means through the wireline winch.

36. The method according to claim 21 wherein the winch motor control signal comprises a RPM value and a torque value.

37. The method according to claim 21 further comprising entering operator commands, displaying winch system status and providing feedback to an operator of heave compensation status at an operator control and display means.

38. The method according to claim 21 wherein the controlled speed is substantially constant.

39. A method of compensating for vertical motion of a floating vessel comprising:

a. receiving vessel vertical motion data and logging tool tension set points by a winch control means;

b. raising and lowering a wireline cable within a wellbore by a wireline winch connected to the winch control means further comprising a winch motor for attaching to and rotatably moving a cable drum, the wireline cable having at least one logging measurement tool attached to an end of the cable extending from the cable drum;

c. combining the vertical motion data and logging tool tension set points by the winch control means to produce a winch motor control signal for controlling the rotatable movement of the cable drum so as to cause the wireline cable to achieve movement within the wellbore at a controlled speed independent of vessel vertical motion and d. calculating a heave compensation depth error by combining the measured wireline cable motion data and the vessel vertical motion data.

40. A system for compensating for vertical motion of a floating vessel comprising:

a. a winch controller for receiving vessel vertical motion data from a motion reference unit and operator entered logging tool speed set points from an operator control panel, the winch controller having control logic responsive to the motion data and the operator entered logging tool speed set points to produce a winch control signal output;

b. a winch motor connected to the winch control signal output and having an output drive wherein the winch control motor adjusts the speed and direction of the output drive in response to the winch control signal output;

c. a cable drum connected to the output drive and connected to a wireline cable having at least one logging measurement tool attached;

d. the winch motor adjusts the speed and direction of the output drive so to achieve movement of the wireline cable within a wellbore at a controlled speed independent of vessel vertical motion and e. a depth measurement system for calculating a heave compensation depth error by combining the measured wireline cable motion data and the vessel vertical motion data.

41. A system for compensating for vertical motion of a floating vessel comprising:

a. a winch controller for receiving vessel vertical motion data from a motion reference unit and operator entered logging tool tension set points from an operator control panel, the winch controller having control logic responsive to the motion data and the operator entered logging tool tension set points to produce a winch control signal output;

b. a winch motor connected to the winch control signal output and having an output drive wherein the winch control motor adjusts the speed and direction of the output drive in response to the winch control signal output;

c. a cable drum connected to the output drive and connected to a wireline cable having at least one logging measurement tool attached; and d. the winch motor adjusts the speed and direction of the output drive so to achieve movement of the wireline cable within a wellbore at a controlled speed independent of vessel vertical motion.

42. A system according to claim 41 further comprising:

a. a depth measurement system for receiving vessel vertical motion data and measured wireline cable motion data; and b. the depth measurement system calculates a heave compensation depth error by combining the measured wireline cable motion data and the vessel vertical motion data.

* * * * *